US005108706A

United States Patent [19]

Saggiorato

[11] Patent Number: 5,108,706

[45] Date of Patent: Apr. 28, 1992

[54] DISPOSABLE HYGIENIC SUPPORT FOR CLEANING AND DRYING REACTIVE DIAGNOSTIC STRIPS

[76] Inventor: Renato Saggiorato, Località ROUYE no. 6, 11020 Saint Crhistophe (AO), Italy

[21] Appl. No.: 244,688

[22] Filed: Sep. 15, 1988

[30] Foreign Application Priority Data

Sep. 25, 1987 [IT] Italy ..... 11753/87[U]

[51] Int. Cl.[5] ..... B01L 11/00

[52] U.S. Cl. ..... 422/99; 422/56; 422/57; 422/58; 422/104; 436/169; 206/204; 206/569

[58] Field of Search ..... 422/56, 57, 58, 61, 422/99, 102, 104; 436/169; 73/864.72; 206/204, 206, 569

[56] References Cited

U.S. PATENT DOCUMENTS 2,998,353 8/1961 Ryan ..... 435/805
3,232,710 2/1966 Rieckmann et al. ..... 435/805
3,917,453 11/1975 Milligan et al. ..... 422/56

FOREIGN PATENT DOCUMENTS 0754658 2/1971 Belgium ..... 422/56

*Primary Examiner*—Robert J. Warden
*Assistant Examiner*—Laura E. Collins
*Attorney, Agent, or Firm*—Browdy and Neimark

[57] ABSTRACT

A disposable hygienic support for cleaning and drying reactive diagnostic strips, these strips exhibiting a reacting surface portion in contact with which a fraction of biological material to be analyzed is placed. The support comprises a substantially rigid covering (1) and an element of absorbent material (3) fixed therein. The element is accessible from at least two opposite ends of the covering to permit the insertion of the strip, in such a manner that its reactive portion is on the outside, and the removal of the latter by passing the absorbent element through after a predetermined time of reaction between the reactive portion and the biological liquid. The invention provides a very useful article for handling diagnostic strips in safety conditions.

7 Claims, 1 Drawing Sheet

DISPOSABLE HYGIENIC SUPPORT FOR CLEANING AND DRYING REACTIVE DIAGNOSTIC STRIPS

DESCRIPTION

1. Field of the Invention

The present invention relates to a disposable hygienic support for cleaning and drying reactive diagnostic strips which are commonly used, not only in medical analysis laboratories, but also in hospital departments, in medical out-patients departments and also in the patient's home.

2. Background of the Invention

As is known, such strips are supports of synthetic material, at one end of which a surface is fixed, referred to as the reactive surface, on which the chemical system on which the reaction is based has been absorbed or adsorbed. At the moment of use, such surface is bathed, by immersion or by dripping, with the biological material to be examined (blood, urine, serum, plasma, etc.). Such material remains on the reactive surface for the time determined by the method, after which it is removed, drying the strip with absorbent material, or dripping or washing with water, depending upon the type of reaction which takes place on the strip. Subsequently the reaction proceeds, generally developing a colour on the said reactive surface in proportion to the concentration of the substance to be assayed.

Some of the instances of use of these reactive strips involve the risk that extraneous persons (particularly the operator) and the environment (particularly the surfaces on which the test are undertaken) will become contaminated with the biological material to be examined, thus involving the danger of infection and contamination. There has been constantly increasing awareness of the need to provide protection systems which are simple to use and involve low cost, which permit the avoidance, or at least the greatest possible limitation, of the risks of infection and contamination, this need being emphasized, above all, following the deepening of awareness concerning the diffusion routes of particularly serious diseases, such as viral hepatitis and Aids.

The object of the present invention is therefore to provide an adequate protection, both for environments and for operators, whether in the health sector or not, from the risk of contamination with biological material during certain phases of implementation of the tests using the reactive strips.

SUMMARY OF THE INVENTION

This object is achieved with the disposable hygienic support for cleaning and drying reactive diagnostic strips according to the invention, characterized in that it is composed of a substantially rigid outer covering, in particular formed by a flat element folded into two parts along an intermediate ribbing line, within which there is anchored an element of absorbent material accessible from at least two opposite ends of the said covering to permit the passage of the said strips through the latter both at the time of the arrangement of the strip in such a manner that its reactive surface is on the outside, and on removing the said surface after a predetermined time of reaction with the biological material, in such a manner as to permit the cleaning and the drying thereof with the absorbent element contained within the covering.

DESCRIPTION OF THE DRAWINGS

The invention will now be illustrated in greater detail by the description, which follows, of one of its embodiments, on an exemplifying and not-limiting basis, given with reference to the accompanying drawings, in which.

DESCRIPTION OF A PREFERRED EMBODIMENT

Figure 1:
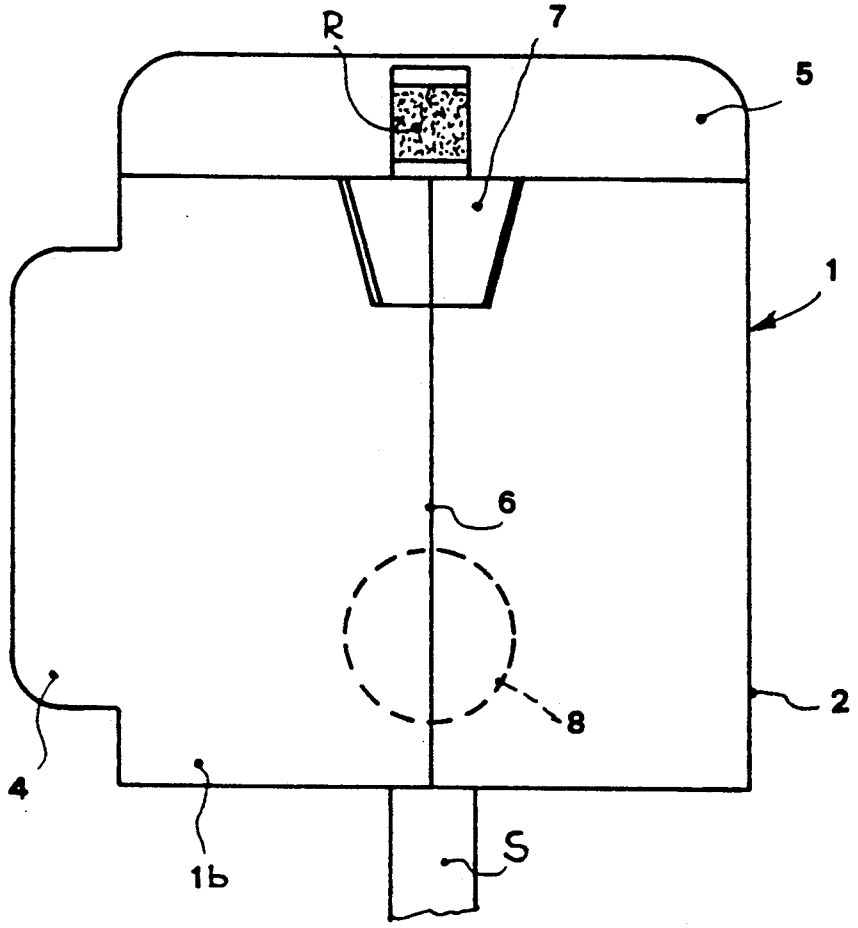
FIG. 1 shows a hygienic support according to the present invention, in which a reactive strip ready for use has been inserted on an exemplifying basis.
Figure 2:
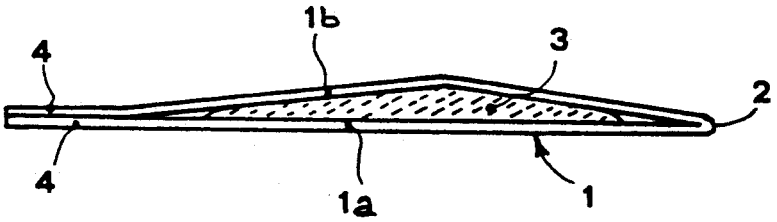
FIG. 2 is a profile view of the support according to FIG. 1.
Figure 3:
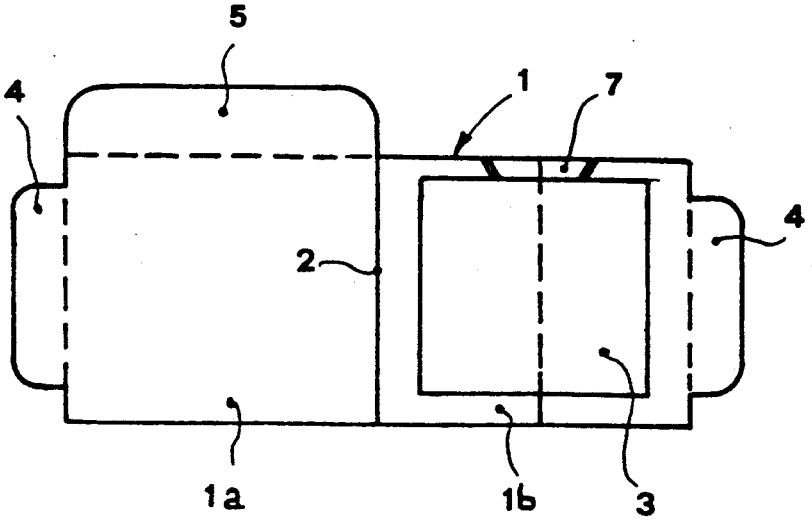
FIG. 3 illustrates the support of FIG. 1 in the open condition.

With reference to the aforementioned figures, 1 indicates a covering of substantially rigid or semirigid material formed by a flat element folded into two parts 1*a* and 1*b* along a preprinted transverse ribbing line 2. The flat element 1 may be constructed, for example, of card which is preferably externally plasticoated, in order to impart thereto a sufficient impermeability. On the internal face of the two parts of the flat element 1, for example on the internal face of the part 1*b*, there is fixed an absorbent element 3 (for example cotton, gauze, cellulose in general, synthetic material and the like). Along the two free sides of the two parts 1*a* and 1*b*, parallel to the ribbing line 2, there extend two tabs 4, by means of which the two aforementioned parts of the flat element 1 are closed, for example by means of adhesive, in such a manner as to form a substantially tubular covering which is pressed down, in the present embodiment, within which the absorbent element 3 is contained. A projected edge 5 is then provided along one of the remaining sides of the part 1*a* of the flat element 1, i.e. that to which, in the present embodiment of the invention, the absorbent element 3 is not fixed. Finally, the part 1*b*, to which the absorbent element 3 is fixed, exhibits a further intermediate transverse fold line 6, as a result of which the part 1*b* assumes a shape which is substantially that of an inverted V broadly opened out towards the internal face of part 1*a*.

In the use of the hygienic support according to the invention, a reactive strip S is inserted within the flat element 1 which has been folded and closed, and in particular between the internal face of the part 1*a* and the absorbent element 3 fixed to the internal face of the part 1*b*. The insertion is facilitated by the fact that the part 1*b* is V-shaped, as a result of which, centrally, the absorbent element 3 is not compressed against the internal face of the part 1*a*. The reactive surface R of the strip S is positioned in correspondence with the edge 6, which consequently acts as support for the same, while the part 1*a* itself serves as sliding base for the strip S. After the organic material has been deposited on the reactive surface R, and the predetermined reaction time has elapsed, the strip S is extracted from the covering in such a manner that the reactive surface R slides in contact with the absorbent element 3, which cleans it and dries it. During the removal of the strip S, in order to ensure an improved contact with the absorbent element 3, it is expedient to press the part 1*b* centrally against the part 1*a*, in correspondence with the fold line 6. Once removed, the strip S is perfectly cleaned and dried and ready for the completion of the reaction, while the covering 1 is thrown away.

It may be advantageous to provide on the part of the covering 1 to which the absorbent element 3 is fixed (the part 1*b*, in the embodiment illustrated here) a liftable edge 7 taken along the transverse fold line 6 in correspondence with the margin close to the projecting edge 5, on which rests the portion of the strip S carrying the reactive surface R. In this way, even in the presence of reactive surfaces of solid thickness, the entrance of such surface R between the part 1*a* and the absorbent element 3 is not obstructed. By virtue of this expedient, moreover, the contact pressure which the absorbent element exerts on the reactive surface R is substantially constant from one test to the other and independent of the pressure exerted by the operator. It must, in fact, be borne in mind that, while the operator presses on the zone 8 of the support, which zone is indicated by the broken line in FIG. 1, the cleaning of the reactive surface R takes place almost exclusively in correspondence with the absorbent area portion 3 underneath, or near, the liftable edge 7. This ensures a marked reliability of the results of the tests.

In particular, when the reactive strip is used for tests on blood, a drop of which is generally taken from a finger, the part 1*b* may exhibit an opening in correspondence with the zone 8. From such opening a portion of the absorbent element 3 underneath is accessible, which can therefore be used to clean the point where the blood is taken. In this case, the absorbent element may be formed by two distinct elements, one of which is applied in proximity to the liftable edge 7 and intended to clean the reactive strip, and the other applied in correspondence with the opening 8 to clean the finger.

Clearly, the configuration and the dimensions of the disposable hygienic support according to the present invention, illustrated above, are purely exempliflying and indicative, and it is clear that this may be implemented in any tubular or non-tubular conformation (for example folding) provided that it is suitable for the positioning of a reactive strip and for its subsequent cleaning and drying by means of contact with an absorbent element contained therein. The covering 1 may then be constructed of any suitable material, provided that it has sufficient rigidity and, preferably, impermeability, such as, for example, polystyrene, PVC, tin foil, possibly covered with PVC, etc. The absorbent element 3 may also be impregnated with chemical substances of various types, which are suitable, for example, to react with the reactive surface or with other specific properties.

The disposable hygienic support according to the invention may be supplied in packs containing one or more units, possibly contained in cellophane-wrapped bags. Moreover, the hygienic support according to the invention may advantageously be supplied in combination with the reactive strip in suitable packs in foil, already inserted into the support and ready for use.

The invention is not limited to the embodiment described and illustrated above, but includes any variants of implementation thereof.

I claim:

1. A disposable hygienic support for cleaning and drying a reactive surface at one of two ends of a diagnostic strip of an excess of biological material to be analyzed placed on said surface, said support comprising, a substantially rigid covering means for retaining a diagnostic strip and permitting access to two ends of said strip, an element of absorbent material fixed to one side of said covering means, said covering means being open at least two opposite ends to permit the insertion of said diagnostic strip, a reactive surface on a first end of said diagnostic strip projecting from one of said two opposite ends of said covering means, a second end of said diagnostic strip projecting from another of said two opposite ends of said covering means to permit removal of said diagnostic strip through said covering means, wherein during removal of said diagnostic strip after a predetermined time of reaction between said reactive surface and biological material thereon, said reactive surface contacts said element of absorbent material.

2. The support according to claim 1, wherein said covering means is formed by a flat member folded into two parts along an intermediate ribbing line, said element of absorbent material being anchored to an internal face of at least one of said parts.

3. The support according to claim 2, wherein said at least one of said parts of said flat member to which said element of absorbent material is anchored exhibits an inverted V-shaped profile above the other of said parts thereof.

4. The support according to claim 3, wherein said parts are connected to each other along respective edges opposite to said intermediate ribbing line.

5. The support according to claim 4, wherein the one of said parts of flat member to which said element of absorbent material is not fixed has an extended side for supporting the reactive surface of said diagnostic strip.

6. The support according to claim 5, wherein the one of said parts of said flat member to which said element of absorbent material is fixed has a liftable flap formed at an intermediate position of the side facing said extended side.

7. The support according to claim 5, wherein an opening is formed on said one of the parts to which said element of absorbent material is fixed, in correspondence to the latter and in a position remote from said extended side.

* * * * *